US005222875A

United States Patent [19]

Clark

[11] Patent Number: 5,222,875

[45] Date of Patent: Jun. 29, 1993

[54] VARIABLE SPEED HYDRAULIC PUMP SYSTEM FOR LIQUID TRAILER

[75] Inventor: Dennis J. Clark, Kenmore, N.Y.

[73] Assignee: Praxair Technology, Inc., Danbury, Conn.

[21] Appl. No.: 708,891

[22] Filed: May 31, 1991

[51] Int. Cl.[5] ..... F04B 35/02; F04B 39/06

[52] U.S. Cl. ..... 417/390; 417/370; 60/456

[58] Field of Search ..... 60/369, 456, 431; 417/380, 390, 364, 370; 65/35

[56] References Cited

U.S. PATENT DOCUMENTS

| | | | |
|---|---|---|---|
| 2,780,950 | 2/1957 | Province . | |
| 2,961,829 | 11/1960 | Weisenbach | 60/456 |
| 3,853,272 | 12/1974 | Decker et al. | 417/231 |
| 4,009,572 | 3/1977 | Cooper | 60/454 |
| 4,136,855 | 1/1979 | Morrow | 60/483 |
| 4,177,017 | 12/1979 | Schultz | 417/231 |
| 4,416,590 | 11/1983 | Colucci | 417/231 |
| 4,480,967 | 11/1984 | Schulze | 417/370 |

FOREIGN PATENT DOCUMENTS

| | | | |
|---|---|---|---|
| 8907791 | 8/1989 | Australia | 165/35 |

OTHER PUBLICATIONS

Wolansky, Nagohosian & Henke, Fundamentals of Fluid Power, Haughton Mifflin Co., Boston, 1977 pp. 78 & 79.

IOMA Broadcaster, Sep.-Oct., 1984, "Mobile Pumping Systems for Liquid Distribution", Kniphorst, pp. 8-11.

*Primary Examiner*—Richard A. Bertsch
*Assistant Examiner*—Roland McAndrews
*Attorney, Agent, or Firm*—Chung K. Pak

[57] ABSTRACT

The present invention relates to a hydraulic pump system comprising:

(a) a variable displacement pump;
(b) an engine used to drive the variable displacement pump;
(c) a power takeoff unit for engaging or disengaging the engine from the variable displacement pump;
(d) a hydraulic motor driven by the variable displacement pump via hydraulic fluid pressure;
(e) a liquid pump driven by the hydraulic motor;
(f) a hydraulic fluid cooler in communication with the hydraulic motor;
(g) a hydraulic fluid reservoir in communication with the cooling means and the inlet the variable displacement pump;
(h) hydraulic piping and/or hose for connecting the hydraulic motor, cooler, reservoir and variable displacement pump; and
(i) filters located within the hydraulic piping and/or hose.

18 Claims, 3 Drawing Sheets

VARIABLE SPEED HYDRAULIC PUMP SYSTEM FOR LIQUID TRAILER

This invention relates in general to a hydraulic pump system for transferring liquid and, in particular, to a variable speed hydraulic pump system for offloading cryogenic liquids from delivery vehicles.

Offloading liquid from delivery vehicles has been accomplished in a number of ways. In many cases the liquids to be offloaded, such as petroleum products and liquid oxygen, pose a safety hazard if in close proximity to an internal combustion engine. Some offloading systems, therefore, employ a liquid transfer pump, substantial distance away from the internal combustion engine. The internal combustion engine, for example, is used directly to drive the liquid transfer Pump via a long mechanical coupling means to offload liquids from a delivery vehicle. This long mechanical coupling arrangement is, however, undesirable, requiring excessive maintenance characterized by various operating problems.

In response to these problems, an offloading system involving an internal combustion engine, which drives a liquid transfer pump via a hydraulic pump system, is employed. To utilize the hydraulic pump system involved to drive the liquid transfer pump, the system may be Placed in condition for operation by causing the engagement of the engine and a hydraulic pump of the system. The hydraulic pump causes hydraulic fluid to flow through a recirculation loop which consists of a relief valve, a relief control valve, a hydraulic fluid cooler, a low pressure hydraulic filter, a hydraulic fluid reservoir, a hydraulic fluid boost unit and the hydraulic pump in seriatim. Hydraulic fluid flows preferentially through the recirculation loop because the relief control valve is in its open position and the relief valve is in its "by-pass" mode. At the tractor, the air signal is used to close the relief control valve. With the relief control valve in its closed position, the relief valve is shifted from its "bypass" mode position to its "relief" position. Hence, hydraulic fluid flows primarily through the high pressure hydraulic filter to the hydraulic motor. From the hydraulic motor the return flow of hydraulic fluid flows through the hydraulic fluid cooler, the low pressure hydraulic filter, and the hydraulic fluid boost unit to the hydraulic pump. The drain flow from the hydraulic motor is returned to the hydraulic fluid reservoir, from where it eventually returns to the hydraulic pump through the hydraulic fluid boost unit. Some hydraulic fluid may flow through the relief valve to join the return flow of hydraulic fluid from the hydraulic motor upstream of the hydraulic fluid cooler.

As can be seen, the above described hydraulic pump system requires complex piping and control means to circulate hydraulic fluid to operate the hydraulic motor, thereby driving the liquid transfer pump. The problems encountered with this system may include startup difficulties in cold weather, overheating of the system, overfilling of small vessels, excessive noise when operated at high flows, and maintenance problems associated with the high hydraulic pressure (3500 PSIG) piping system. It is, therefore, desirable to alleviate or mitigate these problems associated with this hydraulic system.

SUMMARY OF THE INVENTION

The invention relates to an improvement in a hydraulic Pumping system associated with a tractor trailer liquid delivery vehicle. The improvement lies in, inter alia, (1) reducing high noise levels, excess heat generation, higher energy consumption and hydraulic fluid leakage associated with the conventional hydraulic pumping system, (2) enhancing the flexibility of the hydraulic pumping system in handling various cryogenic liquids, (3) being able to operate the hydraulic system at lower pressures, (4) being able to adjust the flow rate of liquid being pumped to comport with the size of a tank being filled without employing a different hydraulic motor and (5) being able to start-up the hydraulic system in low ambient temperature without using any specialized procedures.

According to one embodiment of the present invention, the improvement is attained in a variable speed hydraulic pumping system comprising:

(a) means for actuating and controlling a variable displacement pump;

(b) first hydraulic fluid line or conduit means for connecting said variable displacement pump to a hydraulic motor;

(c) hydraulic fluid return line or conduit means for connecting said hydraulic motor to said variable speed hydraulic pump;

(d) second hydraulic fluid line or conduit means for connecting said variable displacement pump to cooling means;

(e) hydraulic fluid drain line or conduit means for connecting the hydraulic motor to said cooling means or to said second hydraulic fluid line or conduit means, which is in communication with said cooling means;

(f) a third hydraulic fluid line or conduit means for directly connecting said cooling means to a hydraulic fluid reservoir; and (g) fourth hydraulic fluid line or conduit means for connecting said reservoir to inlet means of said variable displacement pump or to said hydraulic fluid return line or conduit means.

The variable displacement pump may be driven by an internal combustion engine using a control unit comprising: a power takeoff unit connected to the internal combustion engine having an engage and disengage port; a gas reservoir for providing gas to either the engage or disengage port; the gas reservior in communication with a parking control valve, an air brake cylinder, the control port of a gas operated inversion valve, a power takeoff valve, a power takeoff gas cylinder control valve and the disengage port of the power takeoff unit by means of pneumatic conduits; the gas reservoir also in communication with inlet and outlet ports of the gas operated inversion valve, the power takeoff valve, a solenoid valve, the power takeoff gas cylinder control valve and the engage port of the power takeoff unit by means of pneumatic conduits; and the solenoid valve in communication with an electrical power source. Upon operating the variable displacement pump, energy in the form of hydraulic fluid pressure is transmitted to the hydraulic motor which, in turn, drives a liquid transfer pump.

According to another embodiment of the present invention, the improvement is attained in a variable speed hydraulic pump system having no hydraulic boost unit, hydraulic relief valve and hydraulic control valve comprising:

an engine used to drive a variable displacement pump;

(b) a power takeoff unit for engaging or disengaging said engine to said variable displacement pump;

(c) a hydraulic motor driven by said variable displacement pump via hydraulic fluid pressure;

(d) a liquid pump driven by said hydraulic motor;

(e) a hydraulic fluid cooling means in direct communication with the motor casing of said hydraulic motor;

(f) a hydraulic fluid reservior in direct communication with said cooling means and inlet means of said variable displacement pump;

(g) hydraulic piping and/or hose for connecting said hydraulic motor, cooling means, reservoir and variable displacement pump; and (h) filter means located within said hydraulic piping and/or hose.

As used herein the term "tractor" means a generally diesel powered truck used in hauling tankers.

As used herein the term "trailer" means a mobile tanker unit used to transfer liquids.

As used herein the term "power takeoff unit" means an additional mechanism to the tractor transmission enabling the diesel engine to operate the hydraulic pump.

As used herein the term "hydraulic pump" means a device which converts mechanical force and motion into hydraulic fluid power.

As used herein the term "hydraulic motor" means a device which converts hydraulic energy into mechanical energy to drive the liquid pump.

As used herein the term "power takeoff valve" means a valve which provides a change in flow direction in response to manual movement of the operating knob. The valve blocks the change in flow direction when an air signal is applied to the air pilot port.

As used herein the term "parking control valve" means a valve with delivery port air bias which provides a change of flow direction in response to movement of the operating knob.

As used herein the term "inversion valve" means a normally open valve that changes flow direction in response to an air signal applied to the control port.

As used herein the term "solenoid valve" means a valve which provides a change of flow direction in response to electrically energizing the solenoid coil that moves the solenoid plunger connected to the valve spool.

As used herein the term "power takeoff gas cylinder control valve" means a double gas piloted (one domineering) valve which changes flow direction in response to a gas signal applied to a pilot port. When a gas signal is applied at both pilot ports, the domineering pilot overides the other pilot.

As used herein the term "hydraulic fluid line or conduit means" means any piping and/or hose means compatible to the hydraulic fluid employed. The conduit means may be made of stainless steel and/or light weight, high strength material or composite having suitable liner which is compatible with the hydraulic fluid.

DETAILED DESCRIPTION OF THE INVENTION

Figure 1:
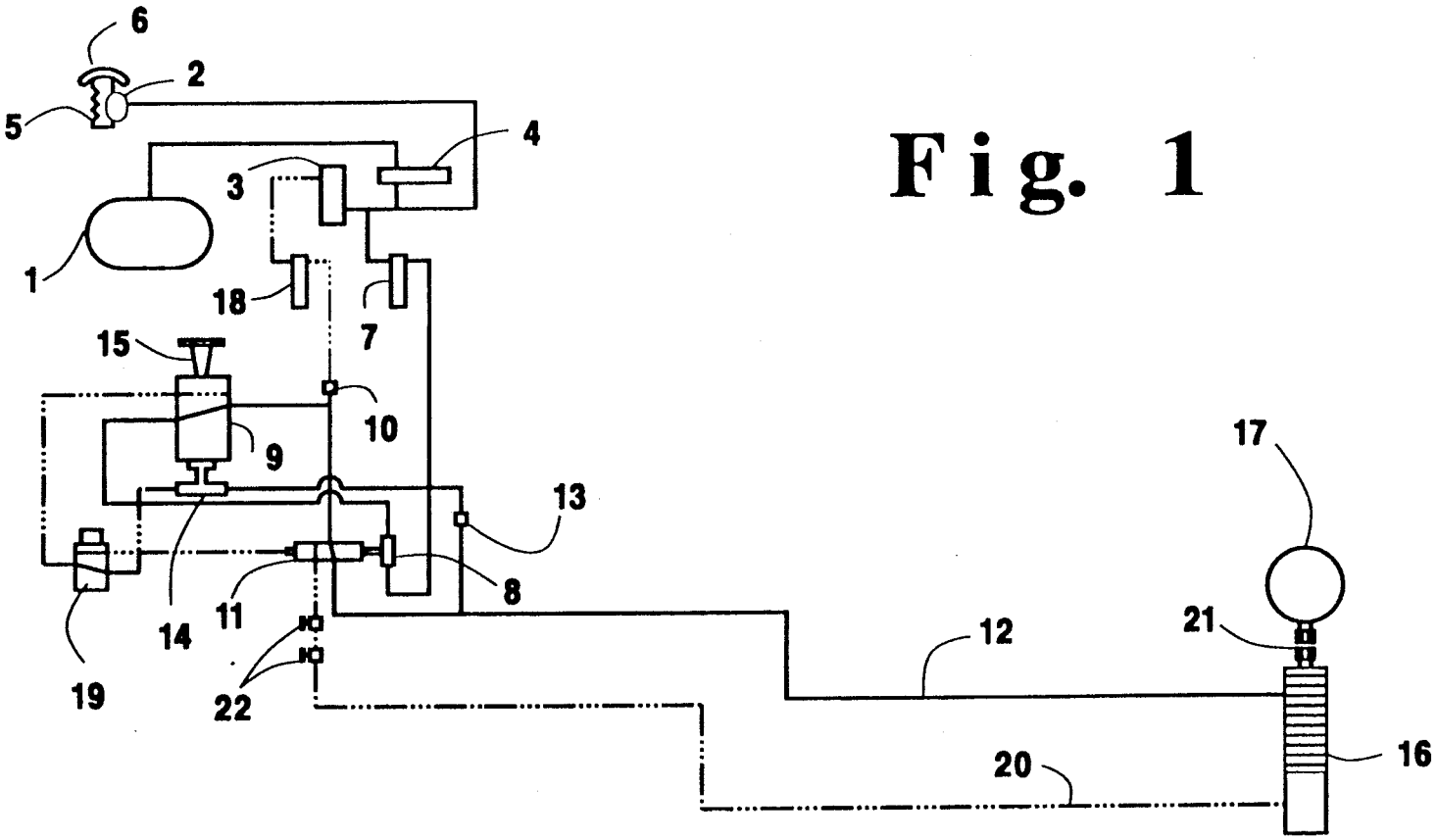
FIG. 1 illustrates a pneumatic control unit which is in a disengage mode.

The invention relates to an improvement in a hydraulic pumping system associated with a tractor trailer liquid delivery vehicle. The hydraulic system employs, inter alia, tractor engine (power takeoff unit) a variable displacement pump and a hydraulic motor. The variable displacement pump is connected to the hydraulic motor that is coupled to shaft connected to a liquid transfer pump. The engine power takeoff unit drives the variable displacement pump to transmit energy to the hydraulic motor. The motor, in turn, drives a liquid transfer pump to transfer liquid from the trailer portion of the vehicle to a customer tank. The primary mechanical components of this system are a prime mover (tractor diesel engine), a variable displacement pump, a hydraulic motor, and a cryogenic pump. Secondary mechanical components consist of a power takeoff (PTO) and gear box between the prime mover and variable displacement pump, a hydraulic fluid cooler, a hydraulic fluid reservoir, a hydraulic fluid accumulator, a high pressure hydraulic fluid filter, a low pressure hydraulic fluid filter, and associated hydraulic fluid piping and hoses. This hydraulic pump system may be arranged such that the liquid pump, shaft, hydraulic motor and associated lines are trailer mounted whereas all remaining portions are tractor mounted. The hydraulic pump system, however, need not be mounted on a tractor trailer vehicle and may be operated by using means other than a tractor engine to power the pump system. Various control units including those disclosed and/or claimed in U.S. Pat. No. 4,416,590—Colucci can be used to operate the hydraulic pump system. The hydraulic system may be safely operated by assuring its operation only when the tractor trailer parking brakes are engaged. The hydraulic system, herein referred to as the variable speed hydraulic pumping system, is usually operated by using three main operating modes which are designated as:

1. Over the Road or disengage mode
2. Standby or engage mode
3. Pumping or pumping mode.

These three phases of operation are described in reference to a preferred variable speed hydraulic pump system as shown in the drawings. However, as can readily be appreciated, the description of a preferred embodiment in no way precludes numerous variations of the hydraulic pump system which will become readily apparent to those skilled in the art.

Referring to FIG. 1, there is illustrated a schematic flow diagram of a control unit associated with a variable speed hydraulic pump system which is in a disengage mode. This mode occurs at any time the tractor trailer is running or is in the mobile status. The variable speed hydraulic pump system associated with off loading liquids cannot be operated or actuated due to its control unit being set in a particular manner as shown in FIG. 1. The dark conduits therein denote the supply of gas at pressure whereas the non-dark conduits therein denote no gas flow or conduits opened to the atmosphere. Initially, the air from the tractor air reservoir (1) is supplied to an air cylinder (2) and the control port of an inversion valve (3) through a parking brake valve (4). The air supplied to the air cylinder causes the cylinder to act against an actuating spring (5) used to apply the tractor Parking brakes (6) to release or disengage the brakes (6). The air supplied to the control port of the inversion valve (3), on the other hand, disengages or disconnects the flow communication between the air inlet port and the air outlet port therein by pressurizing the control port. This disconnection or disengagement effectively prevents the air from the tractor reservoir (1) from being delivered to an engage port (20).

The air passing through the parking brake valve (4) is also supplied to a power takeoff valve (9) through an air line filter (7) and a shuttle valve (8), respectively. The air from the power takeoff valve (9) is then delivered to a power takeoff air cylinder control valve (11) by preventing the flow of air through a check valve (10). The power takeoff air cylinder control valve (11), which is adjusted as a result of pressurizing the shuttle valve (8) by the air flowing therethrough, directs the delivered air to a disengage port (12). A portion of the air in the disengage port is supplied to the pilot of the power takeoff valve (9) through a check valve (13) and a shuttle valve (14) respectively to prevent a manual actuator knob (15) of the power takeoff valve (9) from being depressed or actuated. The remaining air is sent directly to a power takeoff air cylinder (16) through the disengage port (12) causing the disengagement of the tractor engine, power takeoff unit (21), and a variable displacement pump (17). Due to this disengagement, the variable displacement pump (17) is inoperable.

Figure 2:
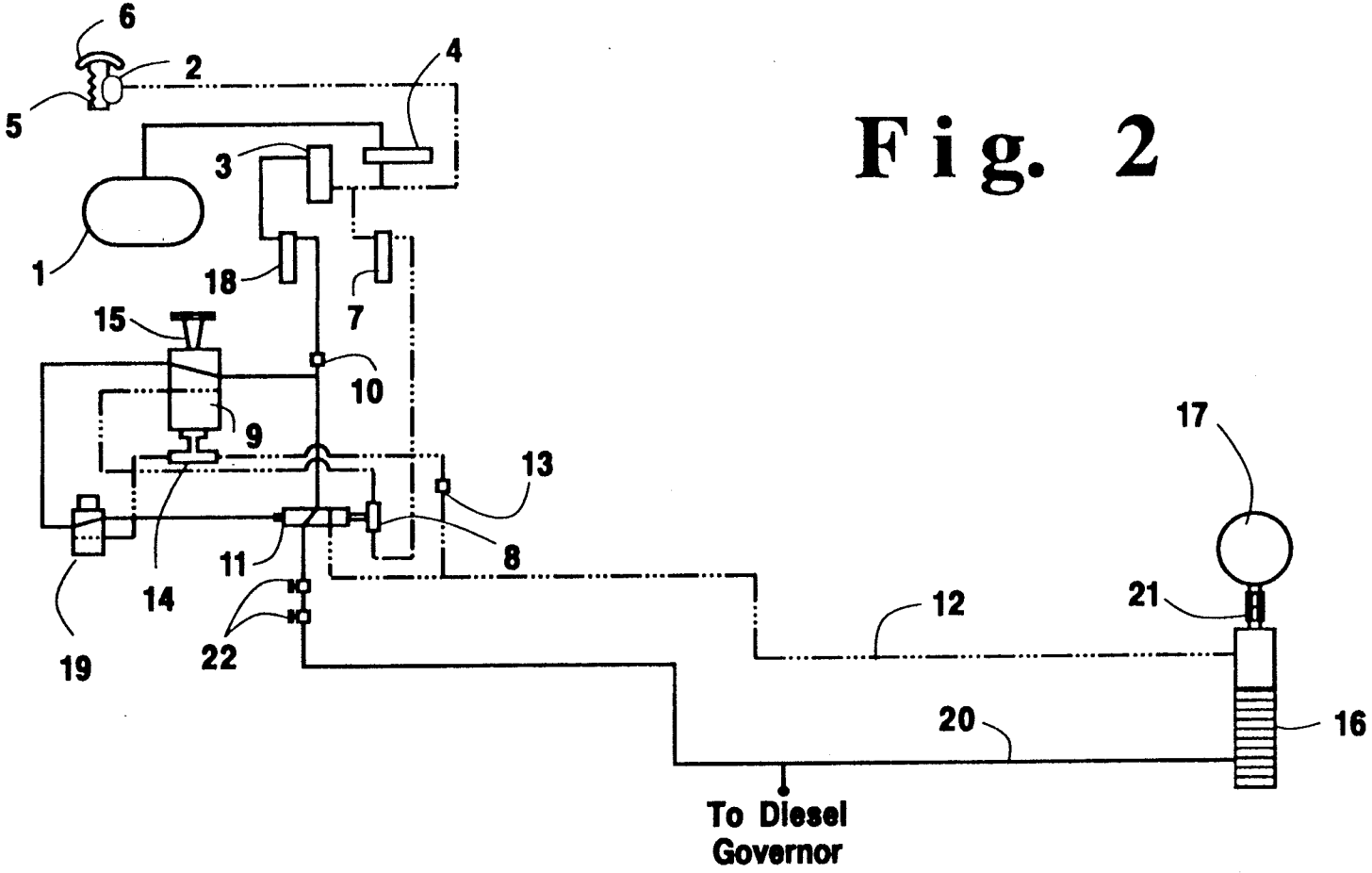
FIG. 2 illustrates a pneumatic control unit which is in an engage mode.

Referring to FIG. 2, there is illustrated a schematic flow diagram of a control unit associated with a variable speed hydraulic pump system which is in an engage mode. This mode occurs when an operator connects a liquid transfer hose or a cryogenic liquid transfer hose to the system and treats or cools the pump (36) in preparation for off-loading the liquid from a trailer. The variable displacement pump (17) is engaged but is in the neutral position and is not producing any hydraulic fluid flow. The dark conduits herein denote the supply of gas at pressure whereas the non-dark conduits denote no gas flow or conduits opened to the atmosphere.

Initially, the parking brake valve (4) is operated to exhaust the air to the tractor parking brakes (6), thus energizing the brakes, and to exhaust the air to the control port of the inversion valve (3). With the depressurization of the control part of the inversion valve (3), air is allowed to pass through the air inlet port and the air outlet port of the inversion valve (3), an air line filter (18) and the check valve (10). By actuating or depressing the manual actuator knob (15) of the power takeoff valve (9), air from the check valve (10) is allowed to pass through the power takeoff valve (9) to reach a solenoid valve (19). The solenoid valve may be or may not be supplied with electrical power. If no electrical power is supplied to the solenoid valve (19), air will be supplied to the pilot port of the power takeoff valve (9) through the solenoid valve (19) and the shuttle valve (14). The resulting air pressure to the pilot port of the power takeoff valve would cause the manual activator knob of the power takeoff valve (9) to pop out, thus shutting off the flow of air to the solenoid valve (19). In contrast, by supplying the electrical power to the solenoid valve (19), air is supplied to the pilot port of the power takeoff air cylinder control valve (11) rather than to the pilot port of the power takeoff valve (7). When the pilot port of the power takeoff air cylinder control valve (11) is pressurized with the supplied air, the power takeoff air cylinder control valve shifts internally to exhaust the disengage port (12) and to allow air to pass through the engage port (20). As the air is supplied to the power takeoff air cylinder (16) through the engage port (20), the power takeoff air cylinder (16) is pressurized to cause the engagement of the tractor engine, power takeoff unit (21), and the variable displacement pump (17). In addition to the pressurization of the power take of air cylinder, the engage port (20) is also pressurized due to the air flowing therethrough. The pressurization of the engage port (20) not only activates pressure switches (22) which allow electrical power to be supplied to an hour meter in the tractor and a flowmeter on the trailer, but also causes an air signal to be sent to the tractor engine speed governor, which alters the tractor engine speed from idle to the preset speed required for pumping. The tractor engine speed required for operating the variable speed hydraulic pumping system is usually independent of the type of liquid being pumped. The tractor engine idle speed is generally set about 700 rpm to about 800 rpm and is subsequently increased to about 1100 rpm to about 1400 rpm to achieve the full capacity for high pressure, i.e. high flow pumping requirements. The preferred operating speed is set at about 1100 rpm.

Figure 3:
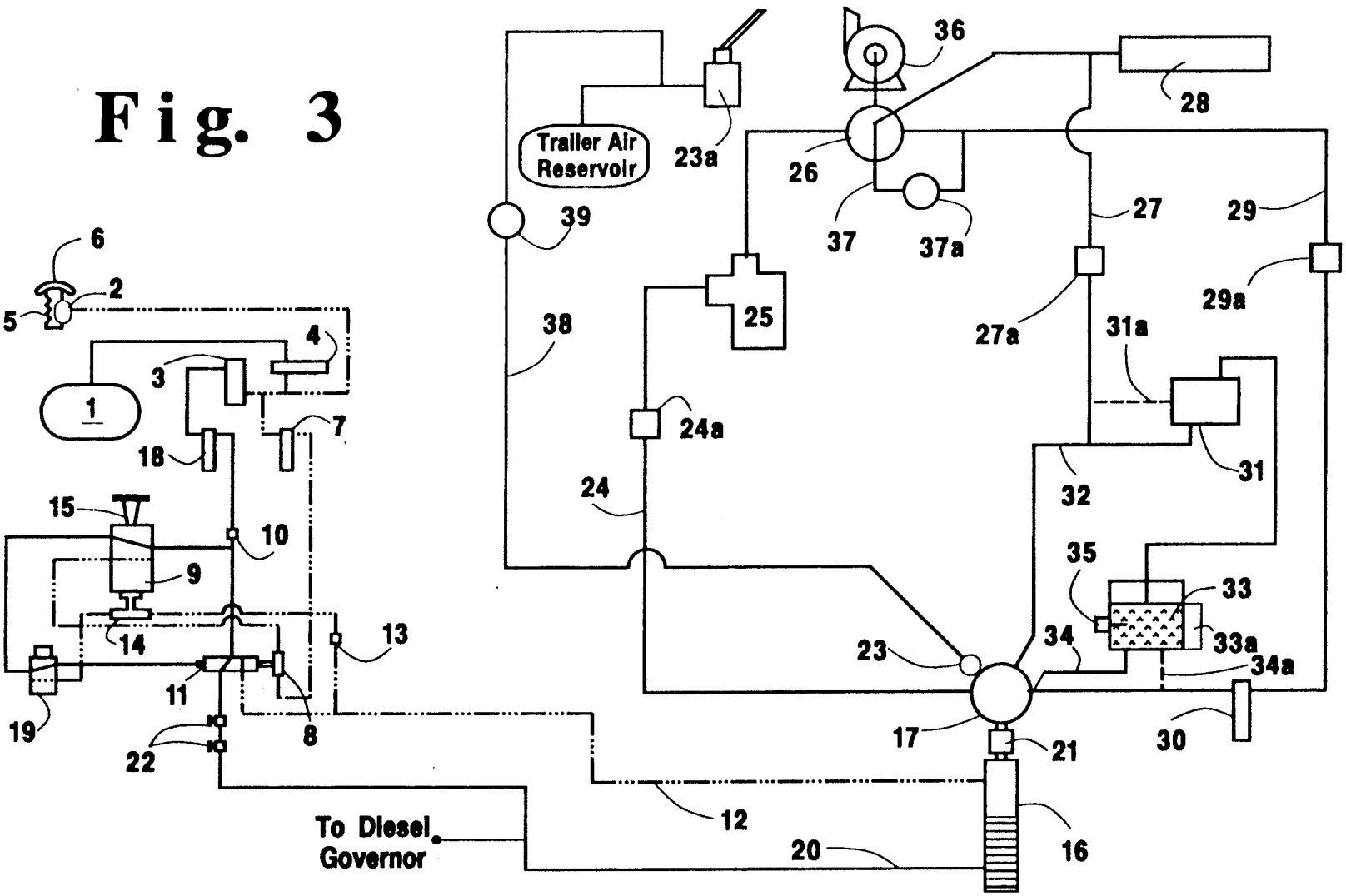
FIG. 3 illustrates a variable speed hydraulic pump system which is in a pumping mode.

Referring to FIG. 3, there is illustrated a schematic flow diagram of a variable speed hydraulic pump system which is in a pumping mode. This mode occurs when the variable speed hydraulic pumping system is fully operational. The variable displacement pump (17) is fully engaged as shown in FIG. 2 and is transmitting energy to a hydraulic motor (26). The hydraulic motor (26), in turn, drives a liquid or cryogenic liquid pump (36) and transfers liquid from the trailer to a customer tank. The dark arrows in FIG. 3 indicate the direction of hydraulic fluid flow or circulation.

Once the pressurized power takeoff air cylinder causes the engagement of the tractor engine, the power takeoff unit (21), an air throttle (23*a*) be actuated to achieve the pumping mode. The air throttle, which may be placed in a piping compartment of the trailer, functions as a pressure regulator that sends an air signal via a line (38) having a pneumatic coupling means (39) to a hydraulic pump actuator (23) on the variable displacement pump (17).

The amount of the air signal delivered to the pump is dependent on the extent of the movement of the control lever of the air throttle (23*a*). As the pressurizing effect of the air signal increases, the pump actuator (23) moves the control lever of the variable speed hydraulic pump (17) in proportion to the increased signal. The control lever of the variable displacement pump (17), which is mechanically connected to the pump actuator (23), controls the position of the pump swashplates through mean of an internally generated hydraulic pressure signal. The position of the pump swashplates of the variable displacement pump (17) can also be regulated by other suitable pump actuating and controlling means. The combination of an electrical rheostat and a signal converter or a hydraulic regulating device, for example, may be used in lieu of the air throttle and the hydraulic pump actuator (23). The electrical rheostat may be used to control or regulate an electrical hydraulic signal converter or a hydraulic regulating device that sends a direct hydraulic signal to the swashplates of the variable displacement pump (17). Through this signal, the position or location of the swashplates is regulated. The position of the pump swashplates governs the amount of fluid flow delivered by the variable displacement pump (17).

The variable displacement pump (17) utilized is preferably a Sundstrand variable displacement pump series 90 made by Sundstrand—Sauer Corporation of Ames, Iowa. The pump, which can be controlled or regulated by either mechanical, electrical or hydraulic means, is capable of handling pressures of up to about 7000 psi and of producing speeds of up to about 5000 rpm. This variable displacement pump (17) produces hydraulic fluid flow at a maximum pressure of about 3000 psig, which is delivered to the hydraulic motor (26) through a supply line (24) having a coupling means (24*a*) and a high pressure hydraulic filter (25) in order to operate a cryogenic pump. From hydraulic motor (26), the hydraulic fluid flows through a drain line (27) having a coupling means (27*a*) and a return line (29) having a coupling means (29*a*). The amount of the hydraulic fluid sent to the drain line (27) via a conduit (37) having an orifice means (37*a*) is typically less than 1% by volume of that sent to the return line (29). The conduit (37) is used to return a portion of the hydraulic fluid in the return line (29) to the hydraulic motor to flush the motor casing for cooling purposes. The drain line (27) may also be associated with or connected to an accumulator (28) which serves as a thermo and pressure compensator. The hydraulic fluid in the drain line (27) is usually fed to a hydraulic reservoir (33) having a fluid temperature switch (35) after passing it to a hydraulic fluid cooler (31) through a line (32) or a line (31*a*). When the hydraulic fluid is at a temperature below about 0° F., it is usually fed to the reservoir (33) through a by-passing means (not shown) located inside or outside of the cooler (31). The cooler (31) may be used not only to ensure the removal of generated heat within the hydraulic circuit or lines but also to prevent the gelatinization of the hydraulic fluid through the use of its by-passing means or system. A heating means (33*a*) may be employed to warm the reservoir (33). When the reservoir is at an extremely low temperature, the heating means provides warm hydraulic fluid with the desired viscosity and upon its passage to the hydraulic line, warms the hydraulic fluid lines.

On the other hand, the hydraulic fluid sent to the return line (29) is fed to the inlet of the variable speed hydraulic pump (17) after it passes through a low pressure hydraulic filter (30). In the inlet of the pump (17), the hydraulic fluid from the return line (29) is combined with a make-up hydraulic fluid provided through a line (34) or a line (34*a*) via a charge pump (not shown) intergral with the pump (17) from the hydraulic fluid reservoir (33). A portion of the combined fluid together with the hydraulic fluid from the drain line (27), is delivered to the reservoir (33) through the line (32) having the hydraulic fluid cooler (31). The remaining portion is supplied to the hydraulic motor (26) to repeat the fluid circulation as stated above. Hydraulic fluid of the phosphate ester type, particularly the phosphate ester sold by AKZO Chemical Company under the trade name HPHLT, may be used.

The hydraulic motor driven by the variable displacement motor (17) in the manner stated above drives a liquid pump or cryogenic liquid pump (36) which is used for offloading liquids including a cryogenic liquid from a trailer to a customer tank. Since the variable displacement pump (17) is regulated or controlled by the air throttle (23*a*), the liquid can be delivered to the customer tank from the trailer at a desired flow rate by properly positioning the lever of the air throttle (23*a*). When the liquid level in the trailer drops below a specified amount, the lever of the air throttle (23*a*) can be adjusted to provide a specified liquid flow rate low enough or sufficient to maintain prime in the liquid pump or cryogenic liquid pump (36) while the trailer is being emptied. At the completion of the pumping mode, the air throttle (23*a*) is placed in the closed position, thereby causing the hydraulic pump actuator (23) to neutralize the variable displacement pump (17). This neutralization causes the cessation of hydraulic fluid flow and returns the hydraulic pumping system to the engage mode as shown in FIG. 2. The hydraulic pumping system may be shut down by returning it to the disengage mode as shown in FIG. 1.

The following example serves to further illustrate the invention. It is presented for illustrative purposes and is not intended to be limiting.

EXAMPLE 1

The variable speed hydraulic pumping system of FIG. 3 was placed in a pumping mode as indicated above under various air throttle pressures as shown in Table I. The table indicates that various liquid flow rates including high liquid flow rates can be obtained at low noise levels under various air throttle pressures.

TABLE 1

| | | Variable displacement Pumping System Startup Test Data | | | | |
|---|---|---|---|---|---|---|
| Test No. | Air Throttle Pressure (PSIG) | Cryogenic Flow Rate (GPM) | Cryogenic Pump Disch. Pressure (PSIG) | Hydraulic Pump Disch. Pressure (PSIG) | Noise (dBa) 3 ft | Level 50 ft |
| 1 | 20 | 48 | 40 | 600 | 77 | 73 |
| 2 | 25 | 6 | 75 | 800 | 79 | 75 |
| 3 | 30 | 44 | 110 | 800 | 84 | 77 |
| 4 | 35 | 46 | 150 | 1450 | 84 | 77 |
| 5 | 40 | 36 | 200 | 1800 | 94 | 81 |
| 6 | 45 | 96 | 210 | 2200 | 93 | 79 |
| 7 | 50 | 100 | 240 | 2400 | 94 | 80 |
| 8 | 55 | 185 | 150 | 2700 | 92 | 81 |
| 9 | 55 | 123 | 250 | 2600 | 95 | 83 |
| 10 | 60 | 160 | 200 | 2700 | 93 | 82 |
| 11 | 60 | | 350 | 3000 | 98 | 85 |

The present invention imparts various advantages in transferring liquid from one container to another by using a particularly arranged hydraulic system which employs a variable speed hydraulic pump. The advantages can be seen in the elimination or mitigation of problems commonly faced in the conventional hydraulic systems. The advantages are detailed below:

1) Small Tank Overfilling: A small tank is difficult to fill when a conventional hydraulic system suitable for filling a large tank is employed. It is now possible to adjust the flow rate of the liquid product to match the size of a tank including a small tank, which is being filled since the flow rate of hydraulic fluid in the present variable speed hydraulic pump system is adjustable over the entire range from zero to maximum flow.

2) High Noise Levels: The power required for offloading a liquid product is lowered when customers are sensitive to the levels of noise emanating from the conventional hydraulic system during delivery periods. Lowering the power required for delivery of product, however, increases the time Period necessary to deliver equivalent product volumes. The present variable speed hydraulic pumping system significantly reduces the noise levels associated with the offloading of product as shown in Table I.

3) Cold Weather Operation: Because of the adjustability of the present variable speed hydraulic pumping system at the low flow end of the operation, it is possible to circulate a small amount of cold, high viscosity hydraulic fluid through the hydraulic fluid line without overpressurizing the system. As this small amount of hydraulic fluid is circulated, it will be warmed by frictional effects, thus decreasing its viscosity and increasing its flow rate. This frictional heating may be augmented by supplemental heating of hydraulic fluid resident in the hydraulic fluid reservoir. No specialized start-up technique, however, is needed as in the conventional hydraulic system.

4) Equipment Interchangeability: Due to the range of hydraulic fluid volumetric flow rates available with the present variable speed hydraulic pumping system, it is now possible to meet the varying demands of delivering liquid nitrogen, liquid oxygen and liquid argon products with a single size hydraulic motor. Also, a single preset operating speed for the tractor engine is capable of supplying sufficient power to pump any of the three aforementioned products at the required pressures and volumes.

5) Excess Heat Generation: As the variable speed hydraulic pumping system is designed to allow better utilization of the power delivered by the tractor engine, the amount of energy wasted in the form of heat to raise the temperature of the hydraulic fluid is minimized. Specifically, elimination of the flow of high pressure hydraulic fluid through the relief valve commonly used in the conventional hydraulic pumping system lowers the cooling requirements of the system considerably. Moreover, the hydraulic fluid cooler is placed to cool hydraulic fluid coming from the drain line in the present variable speed hydraulic pumping system. Such placement is effective in controlling the temperature of all of the hydraulic fluid. The hydraulic fluid in the drain line, while significantly smaller ($<1\%$) in volume than that in the return line, is found to carry most of the frictional heat created in the variable speed hydraulic pump and the hydraulic motor.

6) Hydraulic Fluid Leakage: The variable speed drive system is designed to operate at a pressure of 3000 psig or less rather than 3500 psig as is the case with the conventional hydraulic system. Lowering of the operating pressure in conjunction with a reduction of number of external joints (due to a reduction of the total number of required components) reduces both the frequency and severity of hydraulic fluid leaks.

Although the variable speed hydraulic pump system of this invention has been described in detail with reference to certain embodiments, those skilled in the art will recognize that there are other embodiments of the invention within the spirit and scope of the Claims.

What is claimed is:

1. A variable speed hydraulic pump system comprising:

(a) a variable displacement pump (b) means for actuating and controlling said variable displacement pump;

(c) first hydraulic fluid line or conduit means for connecting said variable displacement pump to a hydraulic motor;

(d) second hydraulic fluid line or conduit means for connecting said hydraulic motor to said variable displacement pump;

(e) third hydraulic fluid line or conduit means for connecting said variable displacement pump to a hydraulic fluid cooling means so that said variable displacement pump is in fluid communication with said cooling means;

(f) fourth hydraulic fluid line or conduit means for connecting the hydraulic motor to said third hydraulic fluid line or conduit means;

(g) fifth hydraulic fluid line or conduit means for connecting said cooling means to a hydraulic fluid reservoir; and (h) sixth hydraulic fluid line or conduit means for connecting said hydraulic reservoir to said second hydraulic fluid line or conduit means.

2. A variable speed hydraulic system according to claim 1, further comprising a cryogenic liquid pump means driven by said hydraulic motor.

3. A variable speed hydraulic system according to claim 1, wherein the conduit means contains hydraulic fluid comprising a phosphate ester.

4. A variable speed hydraulic system according to claim 1, wherein said means for actuating and controlling said variable displacement pump comprises an air or a gas throttle, by means of pneumatic conduit, in communication with an air or gas reservoir and a hydraulic pump actuator mechanically connected to a control lever of said variable displacement pump.

5. A variable speed hydraulic system according to claim 1, wherein said cooler comprises a by-passing system which can automatically by-pass a hydraulic fluid at a temperature below about 0° F. around the cooler.

6. A variable speed hydraulic system according to claim 1, further comprising seventh hydraulic fluid line or conduit means for connecting an accumulator to said hydraulic fluid drain line or conduit means.

7. A variable speed hydraulic system according to claim 1, further comprising a means for heating said reservoir.

8. A variable speed hydraulic system according to claim 1, wherein said first hydraulic fluid line or conduits means contains high pressure hydraulic filter means.

9. A variable speed hydraulic system according to claim 1, wherein said second hydraulic fluid line or conduit means contains low pressure hydraulic filter means.

10. A variable speed hydraulic system according to claim 1, further comprising an eighth hydraulic fluid line or conduit means for connecting said second hydraulic fluid lien or conduit means to the casing of said hydraulic motor, which is in communication with said fourth hydraulic fluid line or conduit means and further comprising an orifice means which is located in said eighth hydraulic fluid line or conduit means.

11. A variable speed hydraulic system according to claim 1, further comprising a means for driving said variable displacement pump.

12. A variable speed hydraulic system according to claim 11, wherein said means for driving said variable displacement pump comprises an internal combustion engine; a power takeoff unit connected to said internal combustion engine having an engage and a disengage port; a gas reservoir for providing gas to either said engage or said disengage port; a parking control valve in communication with said gas reservoir, an air brake cylinder, the control port of a gas operated inversion valve, a power takeoff valve, a power takeoff gas cylinder control valve and said disengage port of the power takeoff unit by means of pneumatic conduits; and said gas operated inversion valve through its inlet and outlet ports in communication with said gas reservoir, said power takeoff valve, a solenoid valve which is in communication with an electrical power source, said power takeoff gas cylinder control valve and the engage port of the power takeoff unit by means of pneumatic conduits.

13. A variable speed hydraulic system according to claim 12, wherein said system is implemented in a tractor trailer and is operated only when the tractor trailer parking brakes are engaged.

14. A variable speed hydraulic pump system comprising:

(a) a variable displacement pump
(b) means for actuating and controlling said variable displacement pump;
(c) first hydraulic fluid line or conduit means for connecting said variable displacement pump to a hydraulic motor;
(d) second hydraulic fluid line or conduit means for connecting said hydraulic motor to said variable displacement pump;
(e) third hydraulic fluid line or conduit means for connecting said variable displacement pump to a hydraulic fluid cooling means so that said variable displacement pump is in fluid communication with said cooling means;
(f) fourth hydraulic fluid line or conduit means for connecting the hydraulic motor to said third hydraulic fluid line or conduit means;
(g) fifth hydraulic fluid line or conduit means for connecting said cooling means to a hydraulic fluid reservoir; and
(h) sixth hydraulic fluid line or conduit means for connecting said hydraulic reservoir to inlet means of said variable displacement pump.

15. A variable speed hydraulic pump system comprising:

(a) A variable displacement pump
(b) means for actuating and controlling said variable displacement pump;
(c) first hydraulic fluid line or conduit means for connecting said variable displacement pump to a hydraulic motor;
(d) second hydraulic fluid line or conduit means for connecting said hydraulic motor to said variable displacement pump;
(e) third hydraulic fluid line or conduit means for connecting said variable displacement pump to a hydraulic fluid cooling means so that said variable displacement pump is in fluid communication with said cooling means;
(f) fourth hydraulic fluid line or conduit means for connecting the hydraulic motor to said cooling means;
(g) fifth hydraulic fluid line or conduit means for connecting said cooling means to a hydraulic fluid reservoir; and
(h) sixth hydraulic fluid line or conduit means for connecting said hydraulic reservoir to said second hydraulic fluid line or conduit means.

16. A hydraulic pump system comprising:

(a) a variable displacement pump
(b) means for driving said variable displacement pump;
(c) means for actuating and controlling said variable displacement pump;
(d) means for providing hydraulic fluid from said variable displacement pump to a hydraulic motor through at least one high pressure hydraulic filter;
(e) means for coupling said hydraulic motor to a liquid pump so that the liquid pump is driven upon operating said hydraulic motor;
(f) means for returning a portion of said hydraulic fluid from said hydraulic motor to said variable displacement pump through at least one low pressure hydraulic filter;
(g) means for providing a portion of said hydraulic fluid from said hydraulic motor to at least one cooling means;
(h) means for directly providing a portion of the hydraulic fluid from said variable displacement pump to said at least one cooling means;
(i) means for providing the hydraulic fluid from said at least one cooling means to a fluid reservoir; and
(j) means for passing the hydraulic fluid from said reservoir to said variable displacement pump.

17. A hydraulic fluid system according to claim 16, further comprising means for passing a portion of the hydraulic fluid returning to said variable speed hydraulic pump to the hydraulic motor casing for cooling purposes, wherein said hydraulic motor casing is in communication with said means for providing a portion of said hydraulic fluid from said hydraulic motor to said reservoir.

18. A variable speed hydraulic pump system comprising:

(a) a variable displacement pump having outlet means for passing hydraulic fluid and inlet means for receiving hydraulic fluid;
(b) an engine used to drive said variable displacement pump;
(c) a power takeoff unit for engaging or disengaging said engine to said variable displacement pump;
(d) a hydraulic motor having an inlet, an outlet and a casing, with the inlet of said hydraulic motor being in fluid communication with said outlet of said variable displacement pump so that said motor can be driven by said variable displacement pump via hydraulic pressure;
(e) a hydraulic fluid cooling means in fluid communication with the casing of said hydraulic motor which in turn is in fluid communication with the outlet of said hydraulic motor;
(f) a hydraulic fluid reservoir for receiving hydraulic fluid from said cooling means in direct fluid communication with said inlet means of said variable displacement pump;
(g) hydraulic piping or hose for connecting said hydraulic motor, cooling means, reservoir and variable displacement pump; and
(h) filter means located within said hydraulic piping or hose.

* * * * *